US006033084A

United States Patent [19]

Burke

[11] Patent Number: 6,033,084

[45] Date of Patent: Mar. 7, 2000

[54] RETROFITTABLE MAILBOX LIGHT SYSTEM

[76] Inventor: June G. Burke, 55534 AL Hwy. 22, Roanoke, Ala. 36274

[21] Appl. No.: 09/016,962

[22] Filed: Feb. 2, 1998

[51] Int. Cl.[7] ..... F21V 33/00

[52] U.S. Cl. ..... 362/155; 362/200

[58] Field of Search ..... 362/155, 200, 362/154, 253

[56] References Cited

U.S. PATENT DOCUMENTS

| | | | |
|---|---|---|---|
| 3,572,581 | 3/1971 | McLeod | 232/35 |
| 4,163,225 | 7/1979 | Engel | 340/569 |
| 4,428,033 | 1/1984 | McBride | 362/183 |
| 4,613,847 | 9/1986 | Scolari et al. | 340/114 |
| 4,648,012 | 3/1987 | Pittman, II | 362/155 |
| 4,755,915 | 7/1988 | Rogers | 362/155 |
| 4,860,949 | 8/1989 | Monroe | 232/35 |
| 4,950,202 | 8/1990 | Florio | 446/219 |
| 5,143,285 | 9/1992 | Wise | 232/39 |
| 5,685,630 | 11/1997 | Herman | 362/155 |
| 5,813,749 | 9/1998 | Sheldon | 362/155 |

*Primary Examiner*—Alan Cariaso
*Assistant Examiner*—John Anthony Ward

[57] ABSTRACT

A retrofittable mailbox light system is provided including mailbox and a housing having a releasable coupling mechanism mounted on the housing for allowing the housing to be mounted to an inner surface of the mailbox such that a front face of the housing remains flush with the open front of the mailbox. A lamp is mounted to the housing for illuminating the interior space of the mailbox only upon the receipt of power. A battery is positioned within an interior space of the housing. Also included is a momentary switch mounted to the housing and further connected between the lamp and the battery. The switch is adapted for supplying the lamp with power only upon the release thereof when the lid of the mailbox is opened.

1 Claim, 2 Drawing Sheets

FIG 3
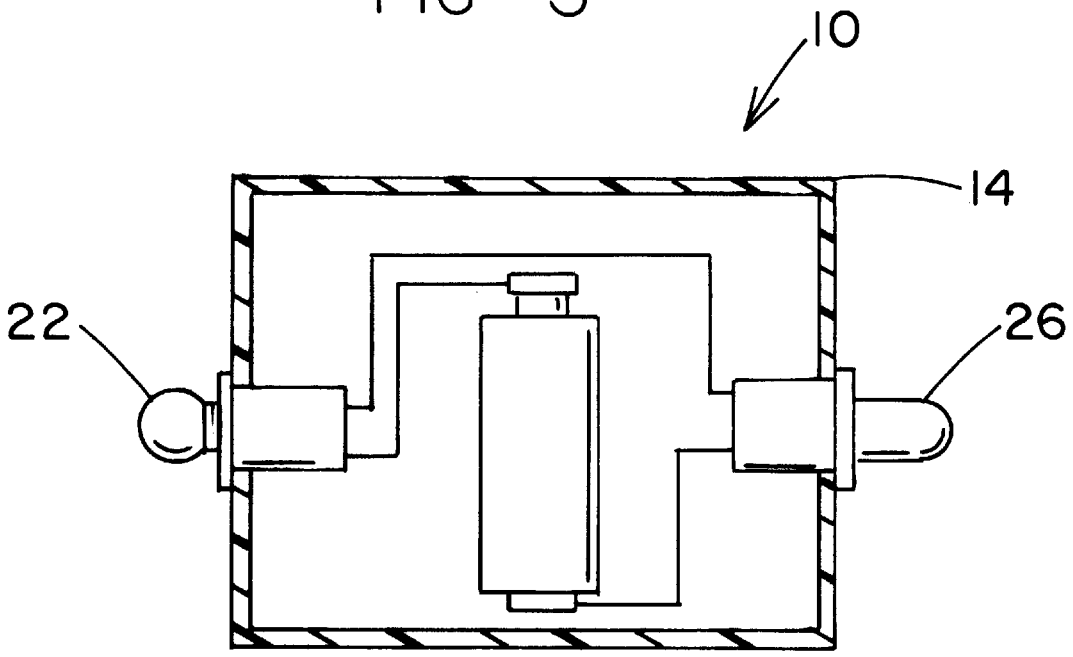
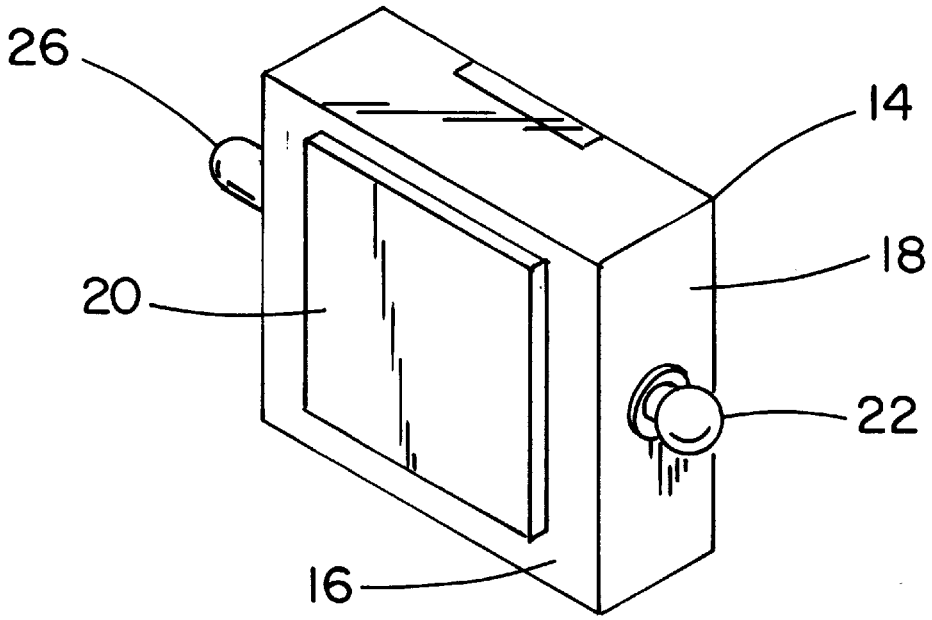
FIG 4

RETROFITTABLE MAILBOX LIGHT SYSTEM

BACKGROUND OF THE INVENTION

1. Field of the Invention

The present invention relates to a retrofittable mailbox light system and more particularly pertains to providing an unobtrusive housing adapted to light a mailbox only when opened.

2. Description of the Prior Art

The use of mailbox light apparatuses is known in the prior art. More specifically, mailbox light apparatuses heretofore devised and utilized for the purpose of lighting a mailbox are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,648,012; U.S. Pat. No. 4,755,915; U.S. Pat. No. 3,935,994; U.S. Pat. No. Des. 313,106; U.S. Pat. No. 4,442,278; and U.S. Pat. No. 5,385,295.

In this respect, the retrofittable mailbox light system according to the present invention substantially departs from the conventional concepts and designs of the prior art, and in so doing provides an apparatus primarily developed for the purpose of providing an unobtrusive housing adapted to light a mailbox only when opened.

Therefore, it can be appreciated that there exists a continuing need for a new and improved retrofittable mailbox light system which can be used for providing an unobtrusive housing adapted to light a mailbox only when opened. In this regard, the present invention substantially fulfills this need.

SUMMARY OF THE INVENTION

In view of the foregoing disadvantages inherent in the known types of mailbox light apparatuses now present in the prior art, the present invention provides an improved retrofittable mailbox light system. As such, the general purpose of the present invention, which will be described subsequently in greater detail, is to provide a new and improved retrofittable mailbox light system which has all the advantages of the prior art and none of the disadvantages.

To attain this, the present invention essentially comprises a mailbox formed from a metallic material and including a closed rear face, a bottom face, a top face, and a pair of side faces formed therebetween for defining an open front and an interior space, the mailbox further including a planar lid hingably coupled to the bottom face adjacent to the open front for allowing the selective closing of the mailbox; a housing including a pair of rectangular planar side faces and a thin periphery formed therebetween for defining an interior space, the periphery defined by a rectangular top face, a rectangular bottom face, a rectangular front face, and a rectangular rear face, one of the side faces having a removable lid mounted thereon for allowing selective access to the interior space of the housing; a magnet mounted on one of the side faces of the housing opposite the lid for allowing the housing to be mounted to an inner surface of one of the side faces of the mailbox such that the front face of the housing remains flush with the open front of the mailbox; a lamp mounted to the rear face of the housing at a central extent thereof for illuminating the interior space of the mailbox only upon the receipt of power; a battery positioned within the interior space of the housing adjacent to the removable lid; and a spring-loaded push button momentary switch mounted to the front face of the housing at a central extent thereof and further connected between the lamp and the battery for supplying the lamp with power only upon the release thereof when the lid of the mailbox is opened.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved retrofittable mailbox light system which has all the advantages of the prior art mailbox light apparatuses and none of the disadvantages.

It is another object of the present invention to provide a new and improved retrofittable mailbox light system which may be easily and efficiently manufactured and marketed.

It is a further object of the present invention to provide a new and improved retrofittable mailbox light system which is of a durable and reliable construction.

An even further object of the present invention is to provide a new and improved retrofittable mailbox light system which is susceptible of a low cost of manufacture with regard to both materials and labor, and which accordingly is then susceptible of low prices of sale to the consuming public, thereby making such retrofittable mailbox light system economically available to the buying public.

Still yet another object of the present invention is to provide a new and improved retrofittable mailbox light system which provides in the apparatuses and methods of the prior art some of the advantages thereof, while simultaneously overcoming some of the disadvantages normally associated therewith.

Still another object of the present invention is to provide an unobtrusive housing adapted to light a mailbox only when opened.

Lastly, it is an object of the present invention to provide a new and improved retrofittable mailbox light system including mailbox and a housing having a releasable coupling mechanism mounted on the housing for allowing the housing to be mounted to an inner surface of the mailbox such that a front face of the housing remains flush with the open front of the mailbox. A lamp is mounted to the housing for illuminating the interior space of the mailbox only upon the receipt of power. A battery is positioned within an interior space of the housing. Also included is a momentary switch mounted to the housing and further connected between the lamp and the battery. The switch is adapted for supplying the lamp with power only upon the release thereof when the lid of the mailbox is opened.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side cross-sectional view of the present invention taken along line 3—3 shown in FIG. 2.

FIG. 4 is a perspective view of the present invention with a magnet.

Similar reference characters refer to similar parts throughout the several views of the drawings.

Description of the Preferred Embodiment

Figure 1:
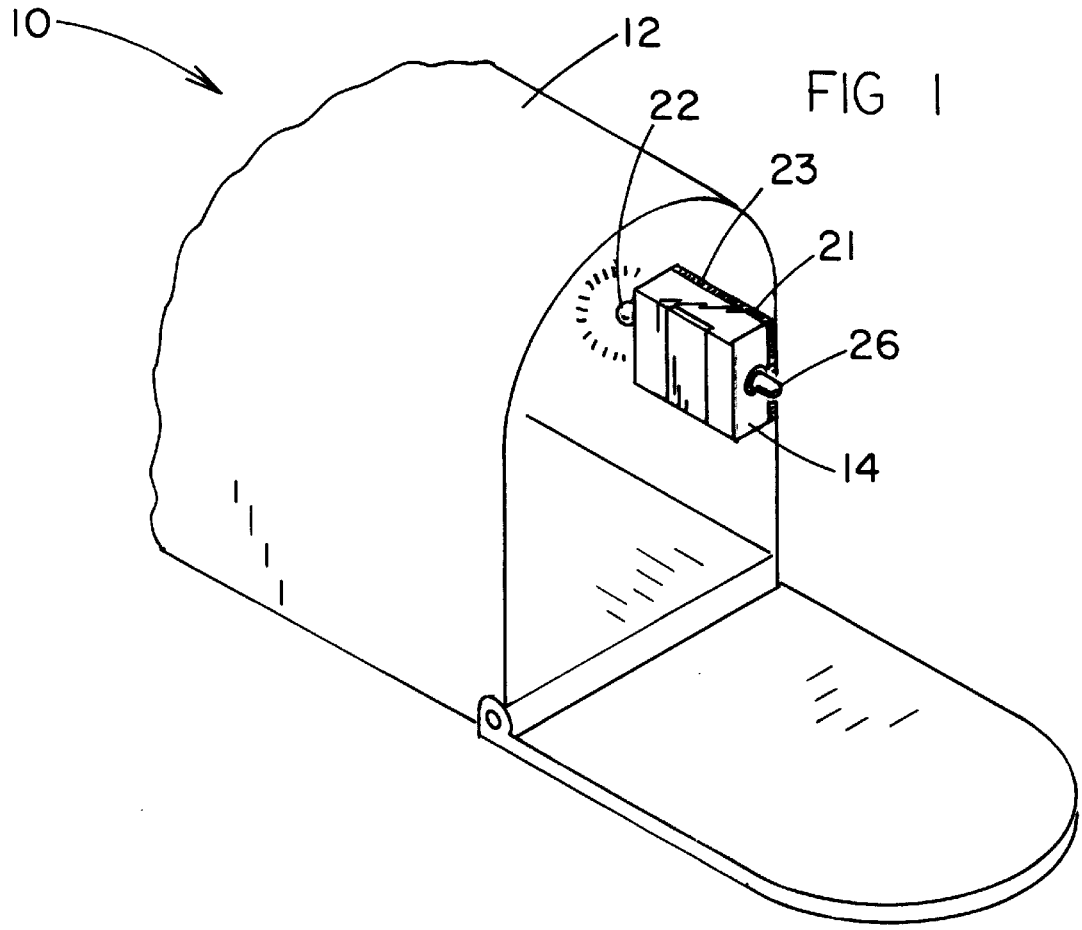
FIG. 1 is a perspective illustration of the preferred embodiment of the retrofittable mailbox light system constructed in accordance with the principles of the present invention.

With reference now to the drawings, and in particular to FIG. 1 thereof, a new and improved retrofittable mailbox light system embodying the principles and concepts of the present invention and generally designated by the reference numeral 10 will be described.

The present invention, the new and improved retrofittable mailbox light system, is comprised of a plurality of components. Such components in their broadest context includes a mailbox and a removable housing with a lamp and switch. Such components are individually configured and correlated with respect to each other so as to attain the desired objective.

More specifically, it will be noted that the system 10 of the present invention includes a mailbox 12 formed from a metallic material. The mailbox includes a closed rear face, a bottom face, a top face, and a pair of side faces formed therebetween for defining an open front and an interior space. The mailbox further includes a planar lid hingably coupled to the bottom face adjacent to the open front for allowing the selective closing of the mailbox.

Further provided is a housing 14 including a pair of rectangular planar side faces 16 and a thin periphery 18 formed therebetween for defining an interior space. The periphery is defined by a rectangular top face, a rectangular bottom face, a rectangular front face, and a rectangular rear face. In the preferred embodiment, each face of the periphery has an area that is less than ⅓ that of each of the side faces for affording a less obtrusive housing. One of the side faces has a removable lid mounted thereon for allowing selective access to the interior space of the housing. Such lid is preferably snappily coupled to the remaining portion of the housing.

Figure 2:
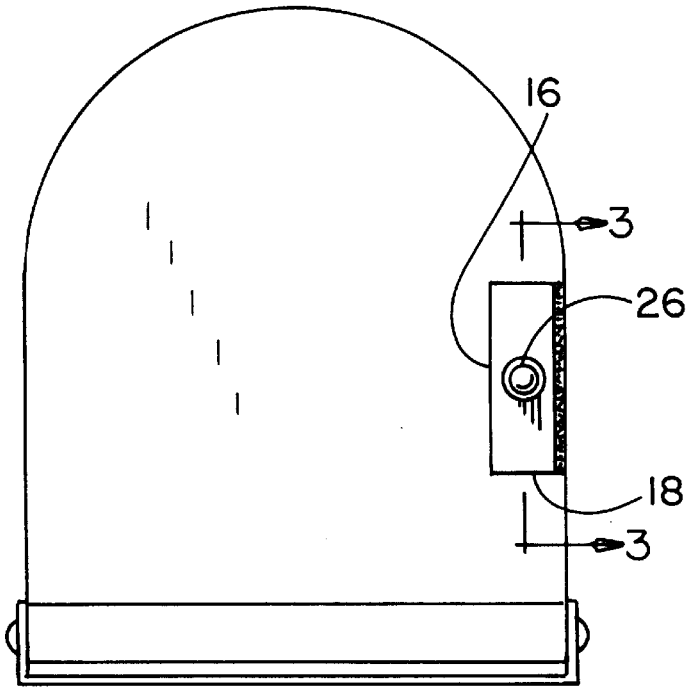
FIG. 2 is a front view of the present invention with pile fasteners.

Also included is a magnet 20 mounted on one of the side faces of the housing opposite the lid. The magnet permits the housing to be mounted to an inner surface of one of the side faces of the mailbox. When mounted, the front face of the housing remains flush with the open front of the mailbox and is further positioned at a mid point of the associated side face. Ideally, the magnet is thin and has a surface area that is at least ¾ that of the side faces of the housing. In an alternate embodiment, shown in FIGS. 1 & 2, the magnet is replaced by a first pile fastener 21 mounted on the mailbox and a second pile fastener 23 mounted on the housing. This embodiment is ideal for use with a non-metallic mailbox.

An incandescent lamp 22 is mounted to the rear face of the housing at a central extent thereof. The lamp is adapted for illuminating the interior space of the mailbox only upon the receipt of power. Positioned within the interior space of the housing adjacent to the removable lid is at least one 1.5V battery 24.

Next provided is a spring-loaded push button momentary switch 26 mounted to the front face of the housing at a central extent thereof. The switch is connected between the lamp and the battery for supplying the lamp with power only upon the release thereof when the lid of the mailbox is opened.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A retrofittable mailbox light system comprising, in combination:

a mailbox formed from a metallic material and including a closed rear face, a bottom face, a top face, and a pair of side faces formed therebetween for defining an open front and an interior space, the mailbox further including a planar lid hingably coupled to the bottom face adjacent to the open front for allowing the selective closing of the mailbox;

a housing including a pair of rectangular planar side faces and a thin periphery formed therebetween for defining an interior space, the periphery defined by a rectangular top face, a rectangular bottom face, a rectangular front face, and a rectangular rear face, one of the side faces having a removable lid mounted thereon for allowing selective access to the interior space of the housing;

a magnet mounted on one of the side faces of the housing opposite the lid for allowing the housing to be mounted to an inner surface of one of the side faces of the mailbox such that the front face of the housing remains flush with the open front of the mailbox;

a lamp mounted to the rear face of the housing at a central extent thereof between the side faces for illuminating the interior space of the mailbox only upon the receipt of power;

a battery positioned within the interior space of the housing adjacent to the removable lid; and a spring-loaded push button momentary switch mounted to the front face of the housing at a central extent thereof and further connected between the lamp and the battery for supplying the lamp with power only upon the release thereof when the lid of the mailbox is opened, the switch having a forward extent forward of the side faces.

* * * * *